US007910533B2

(12) United States Patent
Somerville Roberts et al.

(10) Patent No.: US 7,910,533 B2
(45) **Date of Patent: *Mar. 22, 2011**

(54) SOLID LAUNDRY DETERGENT COMPOSITION COMPRISING ANIONIC DETERSIVE SURFACTANT AND CALCIUM-AUGMENTED TECHNOLOGY

(75) Inventors: Nigel Patrick Somerville Roberts, Newcastle-upon-Tyne (GB); John Peter Eric Muller, Newcastle-upon-Tyne (GB); Lourdes Marina Ramirez Hernadez, Newcastle-upon-Tyne (GB); Neil Joseph Lant, Newcastle-upon-Tyne (GB); Doris Appleby, Newcastle-upon-Tyne (GB); Malcolm McClaren Dodd, Newcastle-upon-Tyne (GB); Arif Alan Khoudary, Newcastle-upon-Tyne (GB); Brenda Frances Bennie, Newcastle-upon-Tyne (GB); Victor Stuart Reid, Newcastle-upon-Tyne (GB); Simon John Greener, Newcastle-upon-Tyne (GB)

(73) Assignee: The Procter & Gamble Company, Cincinnati, OH (US)

( * ) Notice: Subject to any disclaimer, the term of this patent is extended or adjusted under 35 U.S.C. 154(b) by 475 days.

This patent is subject to a terminal disclaimer.

(21) Appl. No.: 11/504,918

(22) Filed: Aug. 15, 2006

(65) Prior Publication Data

US 2008/0045435 A1 Feb. 21, 2008

(30) Foreign Application Priority Data

Aug. 19, 2005 (EP) ..... 05018033

(51) Int. Cl.
*C11D 17/06* (2006.01)
*C11D 3/10* (2006.01)
*C11D 3/37* (2006.01)

(52) U.S. Cl. ..... 510/276; 510/320; 510/351; 510/356; 510/360; 510/376; 510/392; 510/509

(58) Field of Classification Search ..... 510/276, 510/320, 351, 356, 360, 376, 392, 509
See application file for complete search history.

(56) References Cited

U.S. PATENT DOCUMENTS

| | | | | |
|---|---|---|---|---|
| 3,629,951 | A | 12/1971 | Davis et al. | |
| 3,629,955 | A | 12/1971 | Davis et al. | |
| 3,703,772 | A | 11/1972 | McHugh et al. | |
| 4,321,157 | A * | 3/1982 | Harris et al. | 510/348 |
| 4,353,834 | A * | 10/1982 | Langdon | 554/43 |
| 4,687,592 | A | 8/1987 | Collins et al. | |
| 5,370,826 | A * | 12/1994 | Madison et al. | 510/116 |
| 5,496,487 | A | 3/1996 | Capeci et al. | |
| 5,552,078 | A | 9/1996 | Carr et al. | |
| 5,712,242 | A | 1/1998 | Aouad et al. | |
| 5,756,444 | A | 5/1998 | Walters et al. | |
| 5,962,389 | A | 10/1999 | Partee et al. | |
| 6,025,317 | A * | 2/2000 | Stein et al. | 510/360 |
| 6,113,655 | A * | 9/2000 | Tsunetsugu et al. | 8/137 |
| 6,221,831 | B1 * | 4/2001 | Emery et al. | 510/438 |
| 6,274,545 | B1 | 8/2001 | Mazzola et al. | |
| 6,288,016 | B1 | 9/2001 | Ramanan et al. | |
| 6,455,491 | B2 * | 9/2002 | Bauer et al. | 510/511 |
| 6,509,310 | B1 | 1/2003 | Huish et al. | |
| 6,610,645 | B2 * | 8/2003 | Pancheri et al. | 510/509 |
| 6,635,610 | B1 * | 10/2003 | Tatsuno et al. | 510/276 |
| 7,078,373 | B2 * | 7/2006 | Burrows et al. | 510/351 |
| 2002/0028755 | A1 | 3/2002 | VanDijk et al. | |
| 2003/0158069 | A1 | 8/2003 | Horne et al. | |
| 2003/0211963 | A1 * | 11/2003 | Bettiol et al. | 510/499 |
| 2004/0033921 | A1 * | 2/2004 | Dasque et al. | 510/295 |
| 2004/0097394 | A1 | 5/2004 | Burrows et al. | |
| 2005/0032667 | A1 | 2/2005 | Norenberg et al. | |
| 2005/0187130 | A1 * | 8/2005 | Brooker et al. | 510/445 |
| 2005/0209125 | A1 | 9/2005 | Song et al. | |
| 2006/0035802 | A1 * | 2/2006 | Brooker et al. | 510/445 |
| 2006/0189501 | A1 * | 8/2006 | Lant et al. | 510/392 |
| 2007/0037726 | A1 * | 2/2007 | Brooker et al. | 510/476 |
| 2007/0042926 | A1 | 2/2007 | Roberts | |
| 2007/0042927 | A1 | 2/2007 | Muller et al. | |
| 2007/0042928 | A1 | 2/2007 | Appleby et al. | |
| 2007/0042931 | A1 | 2/2007 | Roberts et al. | |
| 2007/0042932 | A1 | 2/2007 | Appleby et al. | |
| 2007/0173429 | A1 * | 7/2007 | Souter et al. | 510/314 |
| 2007/0173430 | A1 * | 7/2007 | Souter et al. | 510/320 |
| 2007/0179270 | A1 | 8/2007 | Mock-Knoblauch et al. | |

FOREIGN PATENT DOCUMENTS

| | | |
|---|---|---|
| EP | 0349199 | 1/1990 |
| WO | WO 97/43366 | 11/1997 |
| WO | WO 00/18859 | 4/2000 |
| WO | WO 00/18873 | 4/2000 |
| WO | WO 01/16274 A1 * | 3/2001 |
| WO | WO 02/053691 | 7/2002 |
| WO | WO 2005/052105 A | 6/2005 |
| WO | WO 2005/083046 A | 9/2005 |
| WO | WO 2005/083049 A | 9/2005 |

* cited by examiner

*Primary Examiner* — Lorna M Douyon
(74) *Attorney, Agent, or Firm* — Julie A. McConihay; Leonard W. Lewis; Steven W. Miller

(57) ABSTRACT

The present invention relates to a solid laundry detergent composition in particulate form, comprising: (a) anionic detersive surfactant; (b) a calcium-augmented technology; (c) from 0% to less than 5%, by weight of the composition, of zeolite builder; (d) from 0% to less than 5%, by weight of the composition, of phosphate builder and (e) optionally, from 0% to less than 5%, by weight of the composition, of silicate salt.

16 Claims, No Drawings

SOLID LAUNDRY DETERGENT COMPOSITION COMPRISING ANIONIC DETERSIVE SURFACTANT AND CALCIUM-AUGMENTED TECHNOLOGY

FIELD OF THE INVENTION

The present invention relates to solid laundry detergent compositions comprising anionic detersive surfactant and a calcium augmented technology. The compositions of the present invention have good dispensing and dissolution profiles and an excellent cleaning performance.

BACKGROUND OF THE INVENTION

There have been relatively recent attempts by many detergent manufacturers to significantly improve the dissolution and dispensing performance of their granular laundry detergents. The approach many detergent manufacturers have focused on is the significant reduction in the level of, or even the complete removal of, water-insoluble builder, such as zeolite builder, in/from their granular laundry detergent formulations. However, due to the phosphate-usage avoidance legislation in many countries which prevents the detergent manufacturers from incorporating a sufficient amount of phosphate-based water-soluble builders, such as sodium tripolyphosphate, in their granular laundry detergents, and due to the lack of feasible alternative non-phosphate based water-soluble builders available to the detergent manufacturers, the approach many detergent manufacturers have focused on is to not completely replace the zeolite-based builder system with a water-soluble builder system having an equivalent degree of builder capability, but instead to formulate an under-built granular laundry detergent composition.

Whilst this under-built approach does significantly improve the dissolution and dispensing performance of the granular laundry detergent, problems do exist due to the significant amount of cations, such as calcium, that are not removed from the wash liquor by the builder-system of the granular laundry detergent composition during the laundering process. These cations interfere with the anionic detersive surfactant system of the granular laundry detergent composition in such a manner as to cause the anionic detersive surfactant to precipitate out of solution, which leads to a reduction in the anionic detersive surfactant activity and cleaning performance. In extreme cases, these water-insoluble complexes may deposit onto the fabric resulting in poor whiteness maintenance and poor fabric integrity benefits. This is especially problematic when the laundry detergent is used in hard-water washing conditions when there is a high concentration of calcium cations.

The Inventors have found that the cleaning performance of under-built detergent compositions is improved by using an anionic detersive surfactant in combination with a calcium-augmented technology.

U.S. Pat. No. 5,552,078 by Carr et al, Church & Dwight Co. Inc., relates to a powdered laundry detergent composition comprising an active surfactant. It is alleged that compositions of U.S. Pat. No. 5,552,078 exhibit excellent cleaning and whitening of fabrics whilst avoiding the problem of eutrophication which occurs when a substantial amount of phosphate-builder is present in the composition, and while minimizing the problem of fabric-encrustation often present when the composition contains a large amount of carbonate builder.

U.S. Pat. No. 6,274,545 B1 by Mazzola, Church & Dwight Co. Inc., relates to a high-carbonate low-phosphate powder laundry detergent formulation which can allegedly be utilized in cold water fabric laundering with a minimized remainder of undissolved detergent residue in the wash liquor. The detergent composition of U.S. Pat. No. 6,274,545 B 1 comprises an anionic/nonionic surfactant blend that is a partially sulphated and neutralized ethoxylated alcohol surfactant, and a polyethylene glycol ingredient, which allegedly increases the solubility of the laundry detergent solids in the wash liquor.

WO97/43366 by Askew et al, The Procter & Gamble Company, relates to a detergent composition that comprises an effervescence system. WO97/43366 exemplifies a carbonate built bleach-free detergent composition.

WO00/18873 by Hartshorn et al, The Procter & Gamble Company, relates to detergent compositions having allegedly good dispensing performance and allegedly do not leave residues on the fabric after the laundering process.

WO00/18859 by Hartshorn et al, The Procter & Gamble Company, relates to detergent compositions allegedly having an improved delivery of ingredients into the wash liquor during the laundering process. The compositions of WO00/18859 allegedly do not as readily gel upon contact with water and allegedly do not leave water-insoluble residues on clothes after the laundering process. The compositions of WO00/18859 comprise a predominantly water-soluble builder system that is intimately mixed with a surfactant system.

WO02/053691 by Van der Hoeven et al, Hindustain Lever Limited, relates to a laundry detergent composition comprising greater than 10 wt % of a calcium tolerant surfactant, from 0.1 wt % to 10 wt % of a strong builder system selected from phosphate builders and/or zeolite builders, and less than 35 wt % of non-functional non-alkaline water-soluble inorganic salts.

SUMMARY OF THE INVENTION

The present invention provides a solid laundry detergent composition in particulate form, comprising: (a) anionic detersive surfactant; (b) a calcium-augmented technology; (c) from 0% to less than 5%, by weight of the composition, of zeolite builder; (d) from 0% to less than 5%, by weight of the composition, of phosphate builder and (e) optionally, from 0% to less than 5%, by weight of the composition, of silicate salt.

DETAILED DESCRIPTION OF THE INVENTION

Solid Laundry Detergent Composition

The composition comprises anionic detersive surfactant, a calcium augmented technology, from 0 to less than 5%, by weight of the composition, of zeolite builder, from 0% to less than 5%, by weight of the composition, of phosphate builder, and optionally from 0% to less than 5%, by weight of the composition, of silicate salt. The composition may comprise other adjunct components. Whilst the composition may comprise silicate salt at levels of 5 wt % or greater, preferably the composition comprises from 0% to less than 5%, by weight of the composition, of silicate salt.

The composition is in particulate form, such as an agglomerate, a spray-dried power, an extrudate, a flake, a needle, a noodle, a bead, or any combination thereof. The composition may be in compacted-particulate form, such as in the form of a tablet. The composition may be in some other unit dose form, such as a pouch, typically being at least partially, preferably completely, enclosed by a water-soluble film such as polyvinyl alcohol. Preferably, the composition is in free-flowing particulate form; by free-flowing particulate form, it is typically meant that the composition is in the form of separate discrete particles. The composition may be made by any suitable method including agglomeration, spray-drying, extrusion, mixing, dry-mixing, liquid spray-on, roller compaction, spheronisation or any combination thereof.

The composition typically has a bulk density of from 450 g/l to 1,000 g/l, preferred low bulk density detergent compositions have a bulk density of from 550 g/l to 650 g/l and preferred high bulk density detergent compositions have a bulk density of from 750 g/l to 900 g/l.

During the laundering process, the composition is typically contacted with water to form a wash liquor having a pH of from above 7 to less than 13, preferably from above 7 to less than 10.5. This is the optimal pH to provide good cleaning whilst also ensuring a good fabric care profile.

The composition typically has an equilibrium relative humidity of from 0% to less than 30%, preferably from 0% to 20%, when measured at a temperature of 35° C. Typically, the equilibrium relative humidity is determined as follows: 300 g of composition is placed in a 1 litre container made of a water-impermeable material and fitted with a lid capable of sealing the container. The lid is provided with a sealable hole adapted to allow insertion of a probe into the interior of the container. The container and its contents are maintained at a temperature of 35° C. for 24 hours to allow temperature equilibration. A solid state hygrometer (Hygrotest 6100 sold by Testoterm Ltd, Hapshire, UK) is used to measure the water vapour pressure. This is done by inserting the probe into the interior of the container via the sealable hole in the container's lid and measuring the water vapour pressure of the head space. These measurements are made at 10 minute intervals until the water vapour pressure has equilibrated. The probe then automatically converts the water vapour pressure reading into an equilibrium relative humidity value.

Preferably, the composition upon contact with water at a concentration of 9.2 g/l and at a temperature of 20° C. forms a transparent wash liquor having (i) a turbidity of less than 500 nephelometric turbidity units; and (ii) a pH in the range of from 8 to 12. Preferably, the resultant wash liquor has a turbidity of less than 400, or less than 300, or from 10 to 300 nephelometric turbidity units. The turbidity of the wash liquor is typically measured using a H1 93703 microprocessor turbidity meter. A typical method for measuring the turbidity of the wash liquor is as follows: 9.2 g of composition is added to 1 litre of water in a beaker to form a solution. The solution is stirred for 5 minutes at 600 rpm at 20° C. The turbidity of the solution is then measured using a H1 93703 microprocessor turbidity meter following the manufacturer's instructions.

Anionic Detersive Surfactant

The detergent composition comprises anionic detersive surfactant. Preferably, the composition comprises from 5% to 25%, by weight of the composition, of anionic detersive surfactant. Preferably, the composition comprises from 6% to 20%, or from 7% to 18%, or from 8% to 15%, or from 8% to 11% or even from 9% to 10%, by weight of the composition, of anionic detersive surfactant. The anionic detersive surfactant is preferably selected from the group consisting of: linear or branched, substituted or unsubstituted $C_{8-18}$ alkyl sulphates; linear or branched, substituted or unsubstituted $C_{8-18}$ linear alkylbenzene sulphonates; linear or branched, substituted or unsubstituted $C_{8-18}$ alkyl alkoxylated sulphates having an average degree of alkoxylation of from 1 to 20; linear or branched, substituted or unsubstituted $C_{12-18}$ alkyl carboxylates; and mixtures thereof. The anionic detersive surfactant can be an alkyl sulphate, an alkyl sulphonate, an alkyl phosphate, an alkyl phosphonate, an alkyl carboxylate or any mixture thereof. The anionic surfactant can be selected from the group consisting of: $C_{10}$-$C_{18}$ alkyl benzene sulphonates (LAS), preferably linear $C_{10}$-$C_{13}$ alkyl benzene sulphonates; $C_{10}$-$C_{20}$ primary, branched-chain, linear-chain and random-chain alkyl sulphates (AS), preferred are linear alkyl sulphates, typically having the following formula:

$$CH_3(CH_2)_xCH_2—OSO_3^-M^+,$$

wherein, M is hydrogen or a cation which provides charge neutrality, preferred cations include sodium and ammonium cations, wherein x is an integer of at least 7, preferably at least 9; $C_{10}$-$C_{18}$ secondary (2,3) alkyl sulphates having the following formulae:

$$CH_3(CH_2)_x(\underset{\displaystyle OSO_3^-M^+}{\underset{|}{CH}})CH_3 \quad \text{or} \quad CH_3(CH_2)_y(\underset{\displaystyle OSO_3^-M^+}{\underset{|}{CH}})CH_2CH_3$$

wherein, M is hydrogen or a cation which provides charge neutrality, preferred cations include sodium and ammonium cations, wherein x is an integer of at least 7, preferably at least 9, y is an integer of at least 8, preferably at least 9; $C_{10}$-$C_{18}$ alkyl alkoxy carboxylates; mid-chain branched alkyl sulphates as described in more detail in U.S. Pat. No. 6,020,303 and U.S. Pat. No. 6,060,443; modified alkylbenzene sulphonate (MLAS) as described in more detail in WO 99/05243, WO 99/05242, WO 99/05244, WO 99/05082, WO 99/05084, WO 99/05241, WO 99/07656, WO 00/23549, and WO 00/23548; methyl ester sulphonate (MES); alpha-olefin sulphonate (AOS) and mixtures thereof.

Preferred anionic detersive surfactants are selected from the group consisting of: linear or branched, substituted or unsubstituted, $C_{12-18}$ alkyl sulphates; linear or branched, substituted or unsubstituted, $C_{10-18}$ alkylbenzene sulphonates, preferably linear $C_{10-13}$ alkylbenzene sulphonates; linear or branched, substituted or unsubstituted alkyl alkoxylated sulphates having an average degree of alkoxylation of from 1 to 20, preferably linear $C_{10-18}$ alkyl ethoxylated sulphates having an average degree of ethoxylation of from 3 to 7; and mixtures thereof. Highly preferred are commercially available $C_{10-13}$ linear alkylbenzene sulphonates. Highly preferred are linear $C_{10-13}$ alkylbenzene sulphonates that are obtained by sulphonating commercially available linear alkyl benzenes (LAB); suitable LAB include low 2-phenyl LAB, such as those supplied by Sasol under the tradename Isochem® or those supplied by Petresa under the tradename Petrelab®, other suitable LAB include high 2-phenyl LAB, such as those supplied by Sasol under the tradename Hyblene®.

It may be preferred for the anionic detersive surfactant to be structurally modified in such a manner as to cause the anionic detersive surfactant to be more calcium tolerant and less likely to precipitate out of the wash liquor in the presence of free calcium ions. This structural modification could be the introduction of a methyl or ethyl moiety in the vicinity of the anionic detersive surfactant's head group, as this can lead to a more calcium tolerant anionic detersive surfactant due to steric hindrance of the head group, which may reduce the anionic detersive surfactant's affinity for complexing with free calcium cations in such a manner as to cause precipitation out of solution. Other structural modifications include the introduction of functional moieties, such as an amine moiety, in the alkyl chain of the anionic detersive surfactant; this can lead to a more calcium tolerant anionic detersive surfactant because the presence of a functional group in the alkyl chain of an anionic detersive surfactant may minimise the undesirable physicochemical property of the anionic detersive surfactant to form a smooth crystal structure in the presence of free calcium ions in the wash liquor. This may reduce the tendency of the anionic detersive surfactant to precipitate out of solution.

The composition preferably comprises from 0.1% to 10%, by weight of the composition, of alkoxylated anionic detersive surfactant. This is the optimal level of alkoxylated anionic detersive surfactant to provide good greasy soil cleaning performance, to give a good sudsing profile, and to improve the hardness tolerancy of the overall detersive surfactant system. It may be preferred for the composition to comprise from 3% to 5%, by weight of the composition, of alkoxylated anionic detersive surfactant, or it may be preferred for the composition to comprise from 1% to 3%, by weight of the composition, of alkoxylated anionic detersive surfactant.

Preferably, the alkoxylated anionic detersive surfactant is a linear or branched, substituted or unsubstituted $C_{12-18}$ alkyl alkoxylated sulphate having an average degree of alkoxylation of from 1 to 30, preferably from 1 to 10. Preferably, the alkoxylated anionic detersive surfactant is a linear or branched, substituted or unsubstituted $C_{12-18}$ alkyl ethoxylated sulphate having an average degree of ethoxylation of from 1 to 10. Most preferably, the alkoxylated anionic detersive surfactant is a linear unsubstituted $C_{12-18}$ alkyl ethoxylated sulphate having an average degree of ethoxylation of from 3 to 7.

Preferably, at least part of, more preferably all of, the alkoxylated anionic detersive surfactant is in the form of a non-spray-dried powder such as an extrudate, agglomerate, preferably an agglomerate. This is especially preferred when it is desirable to incorporate high levels of alkoxylated anionic detersive surfactant in the composition.

The alkoxylated anionic detersive surfactant may also increase the non-alkoxylated anionic detersive surfactant activity by making the non-alkoxylated anionic detersive surfactant less likely to precipitate out of solution in the presence of free calcium cations. Preferably, the weight ratio of non-alkoxylated anionic detersive surfactant to alkoxylated anionic detersive surfactant present in the composition is less than 5:1, or less than 3:1, or less than 1.7:1, or even less than 1.5:1. This ratio gives optimal whiteness maintenance performance combined with a good hardness tolerancy profile and a good sudsing profile. However, it may be preferred that the weight ratio of non-alkoxylated anionic detersive surfactant to alkoxylated anionic detersive surfactant is greater than 5:1, or greater than 6:1, or greater than 7:1, or even greater than 10:1. This ratio gives optimal greasy soil cleaning performance combined with a good hardness tolerency profile, and a good sudsing profile.

Suitable alkoxylated anionic detersive surfactants are: Texapan LEST™ by Cognis; Cosmacol AES™ by Sasol; BES151™ by Stephan; Empicol ESC70/U™; and mixtures thereof.

The composition may preferably comprise mid-chain branched alkyl sulfates, such as those discussed in U.S. Pat. No. 6,020,303 and U.S. Pat. No. 6,060,443. The composition may preferably comprise mid-chain branched alkyl alkoxy sulfates, such as those discussed in U.S. Pat. No. 6,008,181 and U.S. Pat. No. 6,020,303. The composition may preferably comprise methyl ester sulfonate (MES). The composition may preferably comprise alpha-olefin sulfonate (AOS). The composition may preferably comprise modified alky benzene sulphomate (MLAS), such as those discussed in WO99/05241, WO99/05242, WO99/05243, WO99/05244, WO99/05082, WO99/05084, WO99/07656, WO00/23548 and WO00/23549.

Calcium-Augmented Technology

The composition comprises a calcium augmented technology. The calcium augmented technology is typically a technology, such as an ingredient, that is incorporated into the composition and whose performance is augmented by the presence of calcium cations, especially high concentrations of calcium cations. Preferred calcium augmented technologies are selected from: transition metal ion-based bleach catalysts; bleach boosting ingredients such as imine-based bleach boosting compounds and including oxaziridinium-forming bleach boosting compounds; quaternary nitrile bleach boosting ingredients; enzymes, such as lipase and glucanase.

Bleach Boosting Ingredients

In one embodiment of the present invention, the bleach boosting ingredient typically has a structure corresponding to Formula 1 below:

Formula 1

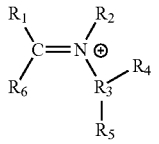

wherein: $R_1$ is a aryl or heteroaryl group that can be substituted or unsubstituted; $R_2$ is a substituted or unsubstituted alkyl; $R_1$ and $R_2$ when taken together with the iminium form a ring $R_3$ is a $C_1$ to $C_{20}$ substituted alkyl; $R_4$ is hydrogen, $R_2$ or, and preferably, the moiety $Q_t$-A, wherein: Q is a branched or un-branched alkylene, t=0 or 1 and A is an anionic group typically selected from the group consisting of $OSO_3^-$, $SO_3^-$, $CO_2^-$, $OCO_2^-$, $OP_3^{2-}$, $OPO_3H^-$ and $OPO_2^-$; $R_5$ is hydrogen, $R_2$ or, and preferably, the moiety —$CR_{11}R_{12}$—X-$G_b$-$X_c$—$[(CR_9R_{10})_y$—$O]_k$—$R_8$, wherein each X is independently selected from the group consisting of O, S, N—H, or N—$R_8$; and each $R_8$ is independently selected from the group consisting of alkyl, aryl and heteroaryl, said $R_8$ moieties being substituted or unsubstituted, and whether substituted or unsubstituted said $R_8$ moieties having less than 21 carbons; each G is independently selected from the group consisting of CO, $SO_2$, SO, PO and $PO_2$; $R_9$ and $R_{10}$ are independently selected from the group consisting of H and $C_1$-$C_4$ alkyl; and $R_{11}$ and $R_{12}$ are independently selected from the group consisting of H and alkyl, or when taken together may join to form a carbonyl; and b=0 or 1; c can=0 or 1, but c must=0 if b=0; y is an integer from 1 to 6; k is an integer from 0 to 20; and $R_6$ is H, or an alkyl, aryl or heteroaryl moiety; said moieties being substituted or unsubstituted.

In one embodiment of the present invention, the bleach boosting ingredient typically has a structure corresponding to Formula 1 above wherein: $R_1$ is a aryl or heteroaryl group that can be substituted or unsubstituted; $R_2$ is a substituted or unsubstituted alkyl; $R_1$ and $R_2$ when taken together with the iminium form a ring; $R_3$ is a $C_1$ to $C_{12}$ substituted alkyl; $R_4$ is the moiety $Q_t$-A, wherein: Q is a $C_1$ to $C_3$ alkyl, t=0 or 1 and A is an anionic group selected from the group consisting of $OSO_3^-$, $SO_3^-$, $CO_2^-$, and $OCO_2^-$; $R_5$ is the moiety —$CR_{11}R_{12}$—X-$G_b$-$X_c$—$R_8$, wherein: each X is independently selected from the group consisting of O, S, N—H, or N—$R_8$; and each $R_8$ is independently selected from the group consisting of alkyl, aryl and heteroaryl, said $R_8$ moieties being substituted or unsubstituted, and whether substituted or unsubstituted said $R_8$ moieties having less than 21 carbons; each G is independently selected from the group consisting of CO, $SO_2$, SO, PO and $PO_2$; $R_{11}$ and $R_{12}$ are independently selected from the group consisting of H and alkyl; b=0 or 1; c can=0 or 1, but c must=0 if b=1; and $R_6$ is H, or an alkyl, aryl or heteroaryl moiety; said moieties being substituted or unsubstituted.

In one embodiment of the present invention, the bleach boosting ingredient typically has a structure corresponding to Formula 1 above wherein: $R_1$ is a aryl or heteroaryl group that can be substituted or unsubstituted; $R_2$ is a substituted or unsubstituted alkyl; $R_1$ and $R_2$ when taken together with the iminium form a six membered ring; $R_3$ is a substituted $C_2$ alkyl; $R_4$ is $OSO_3^-$; $R_5$ is the moiety —$CH_2$—O—$R_8$ wherein $R_8$ is independently selected from the group consisting of alkyl, aryl and heteroaryl, said $R_8$ moiety being substituted or unsubstituted, and whether substituted or unsubstituted said $R_8$ moiety having less than 21 carbons; and $R_6$ is H, or an alkyl, aryl or heteroaryl moiety; said moieties being substituted or unsubstituted.

In another embodiment of the invention, the bleach boosting ingredient typically has a structure corresponding to Formula 2 below:

Formula 2

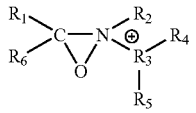

wherein: $R_1$ is a aryl or heteroaryl group that can be substituted or unsubstituted; $R_2$ is a substituted or unsubstituted alkyl; $R_1$ and $R_2$ when taken together with the carbon and the nitrogen of the oxaziridinium form a ring; $R_3$ is a $C_1$ to $C_{20}$ substituted alkyl; $R_4$ is hydrogen, $R_2$ or, and preferably, the moiety $Q_t$-A, wherein: Q is a branched or unbranched alkylene, t=0 or 1 and A is an anionic group selected from the group consisting of $OSO_3^-$, $SO_3^-$, $CO_2^-$, $OCO_2^-$, $OPO_3^{2-}$, $OPO_3H^-$ and $OPO_2^-$; $R_5$ is hydrogen, $R_2$ or, and preferably, the moiety —$CR_{11}R_{12}$—X-$G_b$-$X_c$—$[(CR_9R_{10})_y$—$O]_k$—$R_8$, wherein: each X is independently selected from the group consisting of O, S, N—H, or N—$R_8$; and each $R_8$ is independently selected from the group consisting of alkyl, aryl and heteroaryl, said $R_8$ moieties being substituted or unsubstituted, and whether substituted or unsubstituted said $R_8$ moieties having less than 21 carbons; each G is independently selected from the group consisting of CO, $SO_2$, SO, PO and $PO_2$; $R_9$ and $R_{10}$ are independently selected from the group consisting of H and $C_1$-$C_4$ alkyl; and $R_{11}$ and $R_{12}$ are independently selected from the group consisting of H and alkyl, or when taken together may form a carbonyl; b=0 or 1; c can=0 or 1, but c must=0 if b=0; y is an integer from 1 to 6; k is an integer from 0 to 20; and $R_6$ is H, or an alkyl, aryl or heteroaryl moiety; said moieties being substituted or unsubstituted.

In one embodiment of the present invention, the bleach boosting ingredient typically has a structure corresponding to Formula 2 above, wherein: $R_1$ is a aryl or heteroaryl group that can be substituted or unsubstituted; $R_2$ is a substituted or unsubstituted alkyl; $R_1$ and $R_2$ when taken together with the carbon and the nitrogen of the oxaziridinium form a ring; $R_3$ is a $C_1$ to $C_{12}$ substituted alkyl; $R_4$ is the moiety $Q_t$-A, wherein Q is a $C_1$ to $C_3$ alkyl; t=0 or 1 and A is an anionic group selected from the group consisting of $OSO_3^-$, $SO_3^-$, $CO_2^-$, and $OCO_2^-$; $R_5$ is the moiety —$CR_{11}R_{12}$—X-$G_b$-$X_c$—$R_8$, wherein: each X is independently selected from the group consisting of O, S, N—H, or N—$R_8$; and each $R_8$ is independently selected from the group consisting of alkyl, aryl and heteroaryl, said $R_8$ moieties being substituted or unsubstituted, and whether substituted or unsubstituted said $R_8$ moieties having less than 21 carbons; each G is independently selected from the group consisting of CO, $SO_2$, SO, PO and $PO_2$; $R_{11}$ and $R_{12}$ are independently selected from the group consisting of H and alkyl; b=0 or 1; c can=0 or 1, but c must=0 if b=1; and $R_6$ is H, or an alkyl, aryl or heteroaryl moiety; said moieties being substituted or unsubstituted.

In one embodiment of the present invention, the bleach boosting ingredient typically has a structure corresponding to Formula 2 above, wherein: $R_1$ is a aryl or heteroaryl group that can be substituted or unsubstituted; $R_2$ is a substituted or unsubstituted alkyl; $R_1$ and $R_2$ when taken together with the carbon and the nitrogen of the oxaziridinium form a six member ring; $R_3$ is a substituted $C_2$ alkyl; $R_4$ is $OSO_3^-$; $R_5$ is the moiety —$CH_2$—O—$R_8$ wherein $R_8$ is independently selected from the group consisting of alkyl, aryl and heteroaryl, said $R_8$ moiety being substituted or unsubstituted, and whether substituted or unsubstituted said $R_8$ moiety having less than 21 carbons; and $R_6$ is H, or an alkyl, aryl or heteroaryl moiety; said moieties being substituted or unsubstituted.

Transition Metal Ion-Based Bleach Catalyst

The composition may comprise a transition metal-ion based bleach catalyst. Suitable transition metal ions include cations of copper, iron, titanium, ruthenium, tungsten, molybdenum, or manganese. The transition metal-ion based bleach catalyst may be a manganese-based bleach catalyst, such as those disclosed in U.S. Pat. No. 5,576,282 by Miracle et al. Preferred examples of these bleach catalysts include $Mn^{IV}{}_2$(u-O)$_3$(1,4,7-trimethyl-1,4,7-triazacyclononane)$_2$($PF_6$)$_2$, $Mn^{III}{}_2$(u-O)$_1$ (u-OAc)$_2$(1,4,7-trimethyl-1,4,7-triazacyclononane)$_2$($ClO_4$)$_2$, $Mn^{IV}{}_4$(u-O)$_6$(1,4,7-triazacyclononane)$_4$ ($ClO_4$)$_4$, $Mn^{III}$-$Mn^{IV}{}_4$(u-O)$_1$(u-OAc)$_2$-(1,4,7-trimethyl-1,4,7-triazacyclononane)$_2$($ClO_4$)$_3$, $Mn^{IV}$(1,4,7-trimethyl-1,4,7-triazacyclononane)-($OCH_3$)$_3$($PF_6$), and mixtures thereof.

The transition metal-ion based bleach catalyst may be a cobalt-based bleach catalyst, such as those described in U.S. Pat. No. 5,597,936 by Perkins et al. and U.S. Pat. No. 5,595,967 by Miracle et al. The most preferred cobalt-based bleach catalyst include cobalt pentaamine acetate salts having the formula $[Co(NH_3)_5OAc]T_y$, wherein "OAc" represents an acetate moiety and "$T_y$" is an anion, and especially cobalt pentaamine acetate chloride, $[Co(NH_3)_5OAc]Cl_2$; as well as $[Co(NH_3)_5OAc](OAc)_2$; $[Co(NH_3)_5OAc](PF_6)_2$; $[Co(NH_3)_5OAc](SO_4)$; $[Co(NH_3)_5OAc](BF_4)_2$; and $[Co(NH_3)_5OAc](NO_3)_2$ (herein "PAC"). Such cobalt-based bleach catalysts are readily prepared by known procedures, such as taught for example in U.S. Pat. No. 5,597,936, and U.S. Pat. No. 5,595,967.

The transition metal-ion based bleach catalyst may also comprise a macropolycyclic rigid ligand—abreviated as "MRL". As a practical matter, and not by way of limitation, the compositions and cleaning processes herein can be adjusted to provide on the order of at least one part per hundred million of the MRL in the wash liquor, and will preferably provide from about 0.005 ppm to about 25 ppm, more preferably from about 0.05 ppm to about 10 ppm, and most preferably from about 0.1 ppm to about 5 ppm, of the MRL in the wash liquor. These bleach catalysts include manganese, iron and chromium-based bleach catalysts.

Preferred MRL's are a type of ultra-rigid ligand that is cross-bridged, such as the ligand shown below:

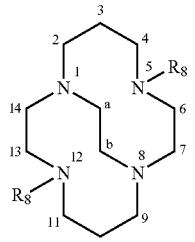

When each $R_8$ is ethyl, this ligand is named, 5,12-diethyl-1,5,8,12-tetraazabicyclo[6.6.2]hexadecane.

Other suitable MRLs include: dichloro-5,12-diethyl-1,5,8,12-tetraazabicyclo[6.6.2]hexadecane manganese(II); diaquo-5,12-diethyl-1,5,8,12-tetraazabicyclo[6.6.2]hexadecane manganese(II); hexafluorophosphate; aquo-hydroxy-5,12-diethyl-1,5,8,12-tetraazabicyclo[6.6.2]hexadecane manganese(III); hexafluorophosphate diaquo-5,12-diethyl-1,5,8,12-tetraazabicyclo[6.6.2]hexadecane manganese(II); tetrafluoroborate dichloro-5,12-diethyl-1,5,8,12-tetraazabicyclo[6.6.2]hexadecane manganese(III); hexafluorophosphate; dichloro-5,12-di-n-butyl-1,5,8,12-tetraaza bicyclo [6.6.2]hexadecane manganese(II); dichloro-5,12-dibenzyl-1,5,8,12-tetraazabicyclo[6.6.2]hexadecane manganese(II); dichloro-5-n-butyl-12-methyl-1,5,8,12-tetraaza-bicyclo [6.6.2]hexadecane Manganese(II); dichloro-5-n-octyl-12-methyl-1,5,8,12-tetraaza-bicyclo[6.6.2]hexadecane Manganese(II); dichloro-5-n-butyl-12-methyl-1,5,8,12-tetraaza-bicyclo[6.6.2]hexadecane Manganese(II).

Suitable transition metal MRLs are readily prepared by known procedures, such as taught for example in WO 00/332601, and U.S. Pat. No. 6,225,464.

Highly Ethoxylated Non-Ionic Surfactant

The composition may comprise a highly ethoxylated non-ionic surfactant, preferably from 1 to 20%, or from 2% to 6%, or from 3% to 5%, by weight of the composition, of highly ethoxylated non-ionic surfactant. Preferred highly ethoxylated non-ionic surfactants have a hydrophilic/lipophilic balance (HLB) value of from 13 to 25, preferably from 15 to 22, more preferably from 16 to 22, lO most preferably from 14 to 19.5. HLB values can be calculated according to the method given in Griffin, J. Soc. Cosmetic Chemists, 5 (1954) 249-256.

In a preferred embodiment, the weight ratio of the anionic detersive surfactant to the highly ethoxylated non-ionic surfactant is within the range of from 0.25:1 to 40:1, preferably from 1:1 to 15:1, or from 1:1 to 10:1 and more preferably from 2:1 to 6:1, and most preferably from 2. 5:1 to 5:1. Examples of suitable highly ethoxylated non-ionic surfactants include the condensation products of aliphatic $C_{8-20}$, preferably $C_{10-16}$ primary or secondary linear or branched chain alcohols or phenols with alkylene oxides, preferably ethylene oxide or propylene oxide, most preferably ethylene oxide, and generally having from 15 to 80, preferably 16 to 80, more preferably up to 20 or from 20 to 80, and most preferably 20 to 50 alkylene oxide groups; typically, the alkylene oxide group is the hydrophilic repeating unit.

According to an especially preferred embodiment of the invention, the nonionic surfactant is an ethoxylated aliphatic alcohol of the formula:

R—(—O—CH2-CH2)n-OH wherein: R is a hydrocarbyl chain having from 8 to 16 carbon atoms, and the average degree of ethoxylation n is from 15 to 50, preferably 20 to 50. The hydrocarbyl chain, which is preferably saturated, preferably contains from 10 to 16 carbon atoms, more preferably from 12 to 15 carbon atoms. In commercial materials containing a spread of chain lengths, these figures represent an average. The hydrocarbyl chain may be linear or branched. The alcohol may be derived from natural or synthetic feedstock. Preferred alcohol feedstocks are coconut, predominantly $C_{12-14}$, and oxo $C_{12}$ alcohols. The average degree of ethoxylation ranges from 15 to 50, preferably from 16 to 50, more preferably from 20 to 50, and most preferably from 25 to 40. Preferred materials have an average alkyl chain length of $C_{12-16}$ and an average degree of ethoxylation of from 15 to 50, more preferably from 25 to 40. An example of a suitable commercially available material is Lutensol AO30, ex BASF, which is a $C_{13-15}$ alcohol having an average degree of ethoxylation of 30. Another example of a suitably commercially available material is a non-ionic ethoxylated alcohol 20EO Genapol C200 ex Clariant, and also the nonionic ethoxylated alcohol 20EO Lutensol T020 ex BASF.

Polyamidoamine

The composition may comprise from 0.01% to 20%, preferably from 0.01% to 10%, more preferably from 0.01% to 8%, by weight of the composition, of a polyaminoamide, preferably a modified polyamidoamine.

Suitable modified polyaminoamides have, depending on their degree of alkoxylation, a number average molecular weight of from 1,000 Da to 1,000,000 Da, preferably from 2,000 Da to 1,000,000 Da and more preferably from 2,000 Da to 50,000 Da.

In general, polyaminoamides are polymers whose backbone chain contains both amine functionalities (*—NH—*) and amide functionalities (*—NH—C(O)—*); the asterisks indicate the polymer backbone. Polyaminoamides typically also contain primary amino groups (—$NH_2$) and/or carboxyl groups (—COOH) at the termini of the polymer chain. As used herein, the term "amino" comprises both the secondary amine functionalities of the polymer backbone and the primary amine functionalities at the termini of the polymer chain. In general polyaminoamides are linear.

Suitable modified polyaminoamide of have a structure corresponding to formula 3 below:

Formula 3

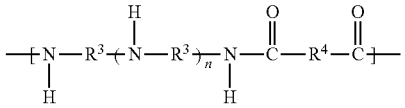

wherein: n is an integer from 1 to 500, preferably from 1 to 100, more preferred from 1 to 20, more preferred from 1 to 10 and most preferred 1, 2 or 3; $R^3$ is selected from $C_2$-$C_8$-alkanediyl, preferably $C_2$-$C_8$-alkanediyl and more preferred 1,2-ethanediyl or 1,3-propane diyl; $R^4$ is selected from a chemical bond, $C_1$-$C_{20}$-alkanediyl, $C_1$-$C_{20}$-alkanediyl comprising 1 to 6 heteroatoms selected from the group consisting of oxygen, sulfur, and nitrogen (imino), $C_1$-$C_{20}$-alkanediyl comprising 1 to 6 heteroatoms selected from the group consisting of oxygen, sulfur, and nitrogen (imino) further comprising one or more hydroxyl groups, a substituted or unsubstituted divalent aromatic radical, and mixtures thereof. The $C_1$-$C_{20}$-alkanediyl comprising 1 to 6 heteroatoms selected from the group consisting of oxygen, sulfur, and nitrogen (imino) may contain 1 or 2 carbon-carbon-double bonds. The $C_1$-$C_{20}$-alkanediyl comprising 1 to 6 heteroatoms selected from the group consisting of oxygen, sulfur, and nitrogen (imino)may, completely or partially, be a constituent of one or more saturated or unsaturated carbocyclic 5- to 8-membered rings. Preferably $R^4$ is $C_2$-$C_6$-alkanediyl.

In a preferred embodiment, the detergent composition comprises a modified polyaminoamide having a structure corresponding to the formula below:

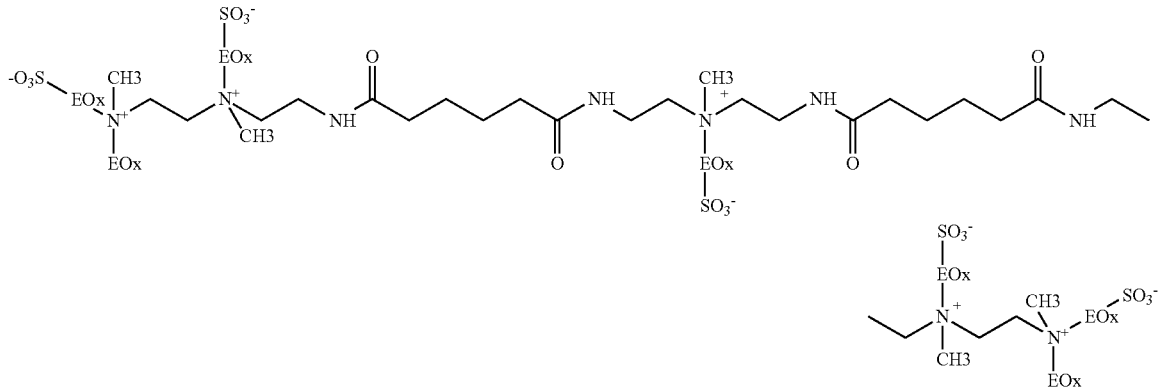

wherein: x is from 10 to 200, preferably from about 15 to about 150, most preferably from about 21 to about 10k0; and EO represents ethoxy moieties.

Quaternary Nitrile Bleach Boosting Ingredient

The composition may comprise a quaternary nitrile bleach boosting ingredient, such as nitrile bleach boosting compounds having a structure corresponding to the formula:

$$(R^1)(R^2)(R^3)N^+—(CR^4R^5)—CN\ X^-$$

wherein: $R^1$ is H, $CH_3$, a $C_{2-24}$-alkyl or alkenyl radical, a substituted $C_{2-24}$-alkyl or -alkenyl radical having at least one substituent from the group consisting of Cl, Br, OH, $NH_2$, CN, an alkyl radical or an alkenylaryl radical having a $C_{1-24}$-alkyl group, or a substituted alkyl or alkenylaryl radical having a $C_{1-24}$-alkyl group and at least one further substituent on the aromatic ring; $R^2$ and $R^3$ independently of one another are selected from —$CH_2$—CN, —$CH_3$, —$CH_2$—$CH_3$, —$CH_2$—$CH_2$—$CH_3$, —CH($CH_3$)—$CH_3$, —$CH_2$—OH, —$CH_2$—$CH_2$—OH, —CH(OH)—$CH_3$, —$CH_2$—$CH_2$—$CH_2$—OH, —$CH_2$—CH(OH)—$CH_3$, —CH(OH)—$CH_2$—$CH_3$, —($CH_2$—$CH_2$—O)$_n$H, where n=1, 2, 3, 4, 5 or 6; $R^4$ and $R^5$ independently of one another have a meaning specified above for $R^1$, $R^2$ or $R^3$; and $X^-$ is any suitable counter-ion such as halides, including chloride, fluoride, iodide and bromide, nitrate, hydroxide, phosphate, hydrogenphosphate, dihydrogenphosphate, pyrophosphate, metaphosphate, hexafluorophosphate, carbonate, hydrogencarbonate, sulfate, hydrogensulfate, $C_{1-20}$-alkyl sulfate, $C_{1-20}$-alkyl sulfonate, unsubstituted or $C_{1-18}$-alkyl substituted arylsulfonate, chlorate, perchlorate and/or the anions of $C_{1-24}$-carboxylic acids, such as formate, acetate, laurate, benzoate or citrate, alone or in any mixtures.

Preferred compounds are those according to the above formula, wherein $R^1$, $R^2$ and $R^3$ are identical, preferably $R^1$, $R^2$ and $R^3$ are methyl groups. Other preferred compounds are those according to the above formula, wherein at least one or two of $R^1$, $R^2$ and $R^3$ are methyl groups and the others being a C2-24 alkyl group.

Burkeite

The composition may comprise burkeite, or some other suitable carrier material. Suitable and preferred carrier materials are crystal growth modified sodium sesquicarbonate ($Na_2CO_3.NaHCO_3.2H_2O$), sodium carbonate ($Na_2CO_3.H_2O$), sodium carbonate/sodium sulphate double salt ($Na_2CO_3.(Na_2SO_4)_2$ burkeite) and mixtures thereof. Such carrier materials may be prepared by preparing a solution or slurry of the salt and a crystal growth modifier followed by drying such solution or slurry by any suitable means known in the art, such as spray drying. Suitable crystal growth modifiers are polycarboxylate compounds. These may be salts of monomeric polycarboxylic acids such as EDTA, NTA and citrate. However, preferred crystal growth modifiers are polymeric polycarboxylates such as homo-polymers and co-polymers of acrylic acid and/or maleic acid. Crystal growth modified sodium carbonate, burkeite and mixtures thereof and their preparation have been fully described in EP0221776A2. The crystal growth modifiers and the procedure described therein are also applicable to the preparation of sodium sesquicarbonate. Preferred carrier materials are crystal modified burkeite and mixtures of crystal modified burkeite and crystal modified sodium carbonate. A slurry or solution comprising sodium sulphate as well as sodium carbonate and crystal growth modifier will on drying crystallize as much as possible in the form of crystal modified burkeite in which the carbonate to sulphate weight ratio is 0.37:1. Any excess sulphate will crystallize as sulphate; any excess carbonate will crystallize as crystal modified carbonate. To obtain sufficient porosity in the crystal mass the slurry or solution of sodium carbonate and sodium sulphate should have a carbonate to sulphate weight ratio of at least 0.03:1, preferably at least 0.1:1 and most preferably between 0.3:1 and 0.45:1. The composition may comprise from 0.1% to 20%, or from 0.2% to 10%, by weight of the composition, of polymeric carboxylates. The composition may comprise from 0.2% to 10%, by weight of the composition, of sesquicarbonate, carbonate salt and/or sulphate salt.

Glucanase

The composition may comprise glucanase, such as β-Glucanases, which are enzymes from the class of endo-1,3-1,4-β-D-glucan-4-glucanohydrolases (EC 3.2.1.73; lichenases). β-Glucanases in the context of the invention also include endo-1,3-β-D-glucosidases (EC 3.2.1.39; laminarinases). Suitable β-Glucanases are obtainable from microorganisms, for example *Achromobacter lunatus, Athrobacter luteus, Aspergillus aculeatus, Aspergillus niger, Bacillus subtilis, Disporotrichum dimorphosporum, Humicola insolens, Peni-*

*cillium emersonii, Penicillium funiculosum* or *Trichoderna reesei*. A commercial product is marketed, for example, under the name of Cereflo® (manufacturer: Novo Nordisk A/S). Preferred β-Glucanases include an enzyme obtainable from *Bacillus alkalophilus* (DSM 9956) which is the subject of German patent application DE 197 32 751.

β-Glucanase is preferably incorporated in the composition in such quantities that the composition has a glucanolytic activity in the range of from 0.05 U/g to 1.00 U/g and more preferably in the range from 0.06 U/g to 0.25 U/g. The determination of glucanolytic activity is based on modifications of the process described by M. Lever in Anal. Biochem. 47 (1972), 273-279 and Anal Biochem. 81 (1977), 21-27. A 0.5% by weight solution of β-glucan (Sigma No. G6513) in 50 mM glycine buffer (pH 9.0) is used for this purpose. 250 μl of this solution are added to 250 μl of a solution containing the agent to be tested for glucanolytic activity and incubated for 30 minutes at 40° C. 1.5 ml of a 1% by weight solution of p-hydroxybenzoic acid hydrazide (PAHBAH) in 0.5M NaOH, which contains 1 mM bismuth nitrate and 1 mM potassium sodium tartrate, are then added, after which the solution is heated for 10 minutes to 70° C. After cooling (2 minutes/0° C.), the absorption at 410 nm is determined against a blank value at room temperature (for example with a Uvikon® 930 photometer) using a glucose calibration curve. The blank value is a solution which is prepared in the same way as the measuring solution except that the glucan solution is added after the PAHBAH solution. 1.00 U corresponds to the quantity of enzyme which produces 1 μmole of glucose per minute under these conditions.

Glucanolytic activities in the washn liquor of from 0.2 U/l to 4 U/l and, more particularly, 0.25 U/l to 1 U/l in the aqueous cleaning solution are preferred. In machine washing processes, for example in the routine washing of domestic laundry in washing machines, the glucanolytic activities mentioned do not have to be maintained over the entire washing cycle to achieve the required washing result providing it is guaranteed that a glucanolytic activity in the range mentioned prevails for at least a short time, for example for about 5 to 20 minutes.

β-Glucanase may be adsorbed onto supports and/or encapsulated in shell-forming substances to protect it against premature inactivation, particularly where it is used in particulate detergents as described, for example, in European patent EP 0 564 476 or in International patent applications WO 94/23005 for other enzymes.

Lipase

The composition may comprise a lipase, preferably selected from the group consisting of Lipolase, Lipolase ultra, 10 LipoPrime, Lipomax, Liposam, Lipex and lipase from *Rhizomucor miehei* (e.g. as described in EP-A-238 023 (Novo Nordisk).

The compositions may comprise a lipase in an amount such that the composition has a lipase activity in the range of from 10 to 20,000 LU/g, and preferably from 50 to 2,000 LU/g. LU (Lipase units) are typically defined in EP-A-258 068 (Novo Nordisk). The lipase can be a fungal lipase, such as those from *Humicola lanuginosa* and *Rhizomucor miehei*. Particularly suitable lipases are from the *Humicola lanuginosa* strain DSM 4109, which is described in EP-A-305 216 (Novo Nordisk), and which is commercially available as Lipolase (TM). Also suitable lipases are described in more detail in WO-A-92/05249, WO-A-94/25577, WO-A-95/22615, WO-A-97/04079, WO-A-97/07202, WO-A-99/42566, WO-A-00/60063. Especially preferred lipases are the lipase variant D96L which is commercially available from Novozymes as Lipolase ultra, the lipase variant which is sold by Novozymes under the trade name LipoPrime, and the lipase variant which is sold by Novozymes under the tradename Lipex. Lipex is described in more detail in WO-A-00/60063. Lipex is a lipase which is a polypeptide having an amino acid sequence which: (a) has at least 90% identity with the wide-type lipase derived from Humicola lanuginosa strain DSM 4109; (b) compared to said wild-type lipase, comprises a substitution of an electrically neutral or negatively charged amino acid at the surface of the three dimensional structure within 15 A° of E1 or Q249 with a positively charged amino acid; (c) comprises a peptide addition at the C— terminal; and/or (d) meets the following limitations: (i) comprises a negative amino acid in position E210 of said wild-type lipase; (ii) comprises a negatively charged amino acid in the region corresponding to positions 9-101 of said wild-type lipase; and (iii) comprises a neutral or negative amino acid at a position corresponding to N94 of said wild-type lipase and/or has a negative or neutral net electric charge in the region corresponding to positions 90-101 of said wild-type lipase. Lipex (the exact lipase variant is Lipolase with the mutations T231R and N233R) exhibits better performance (better stain removal) on the first wash and exhibits especially beneficial synergistic results when combined with bleach catalysts.

Polyvinyl Pyrrolidone

The composition may comprise a polyvinyl pyrrolidone, preferably having a molecular weight in the range of from 1,000 to 200,000 g/mol and more particularly in the range from 1,000 to 100,000 g/mol. Suitable polyvinyl pyrrolidones are typically water-soluble and are typically formed by the polymerization of substituted or unsubstituted vinyl pyrrolidone monomers. They may be both homo-polymers and copolymers where at least one of the monomers is a vinyl pyrrolidone and the vinyl pyrrolidone content of the copolymer is at least 50 mol %; suitable co-monomers including, for example, acrylonitrile or maleic anhydride.

Carboxymethyl Cellulose

The composition may comprise carboxymethyl cellulose. The composition may comprise other cellulosic-based ingredients: such as non-ionic cellulose ethers, including methyl cellulose and methyl hydroxypropyl cellulose typically comprising from 15 wt % to 30 wt % of methoxyl groups and 1 wt % to 15 wt % of hydroxy-propoxyl groups, based on the non-ionic cellulose ether, and the polymers of phthalic acid and/or terephthalic acid or derivatives thereof, more particularly polymers of ethylene terephthalates and/or polyethylene glycol terephthalates or anionically and/or non-ionically modified derivatives thereof. Of these, the sulphonated derivatives of phthalic acid and terephthalic acid polymers are particularly preferred.

Fluorescent-Whitening Agent

The composition may comprise a fluorescent-whitening agent. The fluorescent-whitening agent can be incorporated at levels typically from about 0.05% to about 1.2%, by weight, into detergent composition. Commercial fluorescent-whitening agents that may be suitable can be classified into subgroups, which include, but are not necessarily limited to, derivatives of stilbene, pyrazoline, cournarin, carboxylic acid, methinecyanines, dibenzothiphene-5,5-dioxide, azoles, and 5- and 6-membered-ring heterocycles.

Suitable fluorescent-whitening agents include diaminostilbene disulfonic acid or alkali metal salts thereof, preferably salts of 4,4'-bis-(2-anilino-4-morpholino-1,3,5-triazinyl-6-amino)-stilbene-2,2'-disulfonic acid or compounds of similar structure which contain a diethanolamino group, a methylamino group and anilino group or a 2-methoxyethylamino group instead of the morpholino group. fluorescent-whitening agents of the substituted diphenyl styryl type, for example alkali metal salts of 4,4'-bis-(2-sulfostyryl)-diphenyl, 4,4'-bis-(4-chloro-3-sulfostyryl)-diphenyl or 4-(4-chlorostyryl)-4'-(2-sulfostyryl)-diphenyl, may also be suitable. Mixtures of the fluorescent-whitening agents mentioned above may also be used.

Magnesium Sulphate

The composition may comprise magnesium sulphate. The composition may comprise any dehydrating agent that can absorb water such that, when fully hydrated, at least 25% of its weight is water and it has an equilibrium relative humidity at 25° C. of less than 60%. In this way it can absorb significant amounts of moisture but keep the moisture 'locked away' so that it does not readily evaporate and create powder flow problems. It is also highly preferred that the dehydrating agent, such as magnesium sulphate, is stable with respect to moisture loss up to 50° C. This means that the water absorbed within remains in a stable state up to 50° C.

Suitable dehydrating agents are preferably selected from the group consisting of magnesium sulphate, sodium pyrophosphate, sodium acetate and mixtures thereof. Of these, magnesium sulphate is preferred due to its higher efficacy.

Effervescence System

The composition may comprise an effervescence system, typically any effervescence system that is capable of releasing a gas upon contact with water. Preferred effervescence systems comprise a source of carbonate, such as sodium carbonate and/or sodium bicarbonate, in combination with a source of acid, such as citric acid, sulphamic acid, maleic acid, acrylic acid, or polymers thereof. The source of carbonate and source of acid may be present in the composition in the form of a co-particulate admix, typically being present in the composition in the same particles, or they may be in separate particle admixes from each other.

Another suitable effervescence system comprises a percarbonate that is capable of releasing a gas upon contact with water.

Non-Ionic Detersive Surfactant

The composition may comprise a non-ionic detersive surfactant. The composition may comprise from 0.5% to 10%, by weight of the composition, of non-ionic detersive surfactant. Preferably the composition comprises from 1% to 7% or from 2% to 4%, by weight of the composition, of non-ionic detersive surfactant. The non-ionic detersive surfactant can be selected from the group consisting of: $C_{12}$-$C_{18}$ alkyl ethoxylates, such as, NEODOL® non-ionic surfactants from Shell; $C_6$-$C_{12}$ alkyl phenol alkoxylates wherein the alkoxylate units are ethyleneoxy units, propyleneoxy units or a mixture thereof; $C_{12}$-$C_{18}$ alcohol and $C_6$-$C_{12}$ alkyl phenol condensates with ethylene oxide/propylene oxide block polymers such as Pluronic® from BASF; $C_{14}$-$C_{22}$ mid-chain branched alcohols, BA, as described in more detail in U.S. Pat. No. 6,150,322; $C_{14}$-$C_{22}$ mid-chain branched alkyl alkoxylates, $BAE_x$, wherein x=from 1 to 30, as described in more detail in U.S. Pat. No. 6,153,577, U.S. Pat. No. 6,020,303 and U.S. Pat. No. 6,093,856; alkylpolysaccharides as described in more detail in U.S. Pat. No. 4,565,647, specifically alkylpolyglycosides as described in more detail in U.S. Pat. No. 4,483,780 and U.S. Pat. No. 4,483,779; polyhydroxy fatty acid amides as described in more detail in U.S. Pat. No. 5,332,528, WO 92/06162, WO 93/19146, WO 93/19038, and WO 94/09099; ether capped poly(oxyalkylated) alcohol surfactants as described in more detail in U.S. Pat. No. 6,482,994 and WO 01/42408; and mixtures thereof.

The nonionic detersive surfactant can be a carbonate ester salt, typically with alkaline and alkaline earth metals. Suitable carbonate ester salts have a structure corresponding to the formula:

$$R—O—C(O)—O^- X^+$$

wherein: X=any suitable counterion such as $Na^+$, and R=any substituted or unsubstituted linear or branched alkyl, preferably an alkoxylated alkyl, preferably an ethoxylated alkyl comprising from 1 to 20 ethoxy moieties.

The non-ionic detersive surfactant could be an alkyl polyglucoside and/or an alkyl alkoxylated alcohol. Preferably the non-ionic detersive surfactant is a linear or branched, substituted or unsubstituted $C_{8-18}$ alkyl ethoxylated alcohol having an average degree of ethoxylation of from 1 to 10.

The non-ionic detersive surfactant not only provides additional greasy soil cleaning performance but may also increase the activity of the anionic detersive surfactant by making the anionic detersive surfactant less likely to precipitate out of solution in the presence of free calcium cations. Preferably, the weight ratio of anionic detersive surfactant to non-ionic detersive surfactant, if present, is in the range of less than 8:1, or less than 7:1, or less than 6:1 or less than 5:1, preferably from 1:1 to 5:1, or from 2:1 to 5:1, or even from 3:1 to 4:1.

The non-ionic detersive surfactant, or at least part thereof, can be incorporated into the composition in the form of a liquid spray-on, wherein the non-ionic detersive surfactant, or at least part thereof, in liquid form (e.g. in the form of a hot-melt) is sprayed onto the remainder of the composition. The non-ionic detersive surfactant, or at least part thereof, may be in particulate form, and the non-ionic detersive surfactant, or at least part thereof, may be dry-added to the remainder of the composition. The non-ionic surfactant, or at least part thereof, may be in the form of a co-particulate admixture with a solid carrier material such as carbonate salt, sulphate salt, burkeite, silica or any mixture thereof.

The non-ionic detersive surfactant, or at least part thereof, may be in a co-particulate admixture with either an anionic detersive surfactant or a cationic detersive surfactant. However the non-ionic detersive surfactant, or at least part thereof, is preferably not in a co-particulate admixture with both an anionic detersive surfactant and a cationic detersive surfactant. The non-ionic detersive surfactant, or at least part thereof, may be agglomerated or extruded with either an anionic detersive surfactant or a cationic detersive surfactant.

The non-ionic detersive surfactant may be in solid form at 25° C., such as a polyglucoside or a carbonate ester. The composition may comprise silica and optionally a hydrotrope such as sodium cumene sulphonate, sodium toluene sulphonate, sodium xylene sulphonate, or any mixture thereof. The non-ionic detersive surfactant may be in the form of a co-particulate admix with the silica and optionally the hydrotrope.

If the composition comprises non-ionic detersive surfactant, then the composition is typically prepared by a process wherein the non-ionic detersive surfactant is subjected to a super-heated steam spray-drying process. Typically the steam is at a temperature of at least 200° C., preferably at least 250° C., or at least 300° C., or at least 350° C., or at least 400° C. The mean drying duration period is typically less than 60 seconds, or less than 40 seconds, or even less than 20 seconds. The process typically comprises the steps of (i) preparing a aqueous mixture comprising a detergent ingredient, such as an anionic detersive surfactant; (ii) contacting the non-ionic detersive surfactant to the aqueous mixture; and (iii) subjecting the mixture obtained from step (ii) to a drying step, wherein step (iii) is initiated within 300 seconds, preferably within 200 seconds, or within 100 seconds, or within 50 seconds, or within 25 seconds, or within 10 seconds, or within 5 seconds, of the nonionic surfactant being contacted to the aqueous mixture in step (ii). Preferably step (iii) is a spray-drying step.

The composition may also be prepared by a process comprising the steps of: (i) subjecting a detergent ingredient, such as an anionic detersive surfactant, to a super-heated steam spray-drying step; and (ii) contacting the non-ionic surfactant with the product formed during step (i).

Zeolite Builder

The composition comprises from 0 wt % to less than 5%, or to 4%, or to 3%, or to 2%, or to 1%, by weight of the composition, of zeolite builder. It may even be preferred for the composition to be essentially free from zeolite builder. By essentially free from zeolite builder it is typically meant that the composition comprises no deliberately added zeolite builder. This is especially preferred if it is desirable for the composition to be very highly soluble, to minimise the amount of water-insoluble residues (for example, which may deposit on fabric surfaces), and also when it is highly desirable to have transparent wash liquor. Zeolite builders include zeolite A, zeolite X, zeolite P and zeolite MAP.

Phosphate Builder

The composition comprises from 0 wt % to less than 5 wt %, or to 4%, or to 3%, or to 2%, or to 1%, by weight of the composition, of phosphate builder. It may even be preferred for the composition to be essentially free from phosphate builder. By essentially free from phosphate builder it is typically meant that the composition comprises no deliberately added phosphate builder. This is especially preferred if it is desirable for the composition to have a very good environmental profile. Phosphate builders include sodium tripolyphosphate.

Silicate Salt

The composition optionally comprises from 0 wt % to less than 5%, or to 4%, or to 3%, or to 2%, or to 1%, by weight of the composition, of a silicate salt. It may even be preferred for the composition to be essentially free from silicate salt. By essentially free from silicate salt it is meant that the composition comprises no deliberately added silicate. This is especially preferred in order to ensure that the composition has a very good dispensing and dissolution profiles and to ensure that the composition provides a clear wash liquor upon dissolution in water. Silicate salts include water-insoluble silicates. Silicate salts include amorphous silicates and crystalline layered silicates (e.g. SKS-6). A preferred silicate salt is sodium silicate.

Adjunct Ingredients

The composition typically comprises adjunct ingredients. These adjunct ingredients include: detersive surfactants such as cationic detersive surfactants, zwitterionic detersive surfactants, amphoteric detersive surfactants; preferred cationic detersive surfactants are mono-$C_{6-18}$ alkyl mono-hydroxyethyl di-methyl quaternary ammonium chlorides, more preferred are mono-$C_{8-10}$ alkyl mono-hydroxyethyl di-methyl quaternary ammonium chloride, mono-$C_{10-12}$ alkyl mono-hydroxyethyl di-methyl quaternary ammonium chloride and mono-$C_{10}$ alkyl mono-hydroxyethyl di-methyl quaternary ammonium chloride; source of peroxygen such as percarbonate salts and/or perborate salts, preferred is sodium percarbonate, the source of peroxygen is preferably at least partially coated, preferably completely coated, by a coating ingredient such as a carbonate salt, a sulphate salt, a silicate salt, borosilicate, or mixtures, including mixed salts, thereof; bleach activator such as tetraacetyl ethylene diamine, oxybenzene sulphonate bleach activators such as nonanoyl oxybenzene sulphonate, caprolactam bleach activators, imide bleach activators such as N-nonanoyl-N-methyl acetamide, preformed peracids such as N,N-pthaloylamino peroxycaproic acid, nonylamido peroxyadipic acid or dibenzoyl peroxide; enzymes such as amylases, carbohydrases, cellulases, laccases, oxidases, peroxidases, proteases, pectate lyases and mannanases; suds suppressing systems such as silicone based suds suppressors; photobleach; filler salts such as sulphate salts, preferably sodium sulphate; fabric-softening agents such as clay, silicone and/or quaternary ammonium compounds; flocculants such as polyethylene oxide; dye transfer inhibitors such as polyvinylpyrrolidone, poly 4-vinylpyridine N-oxide and/or co-polymer of vinylpyrrolidone and vinylimidazole; fabric integrity components such as hydrophobically modified cellulose and oligomers produced by the condensation of imidazole and epichlorhydrin; soil dispersants and soil anti-redeposition aids such as alkoxylated polyamines and ethoxylated ethyleneimine polymers; anti-redeposition components such as polyesters; perfumes; sulphamic acid or salts thereof; citric acid or salts thereof; dyes such as orange dye, blue dye, green dye, purple dye, pink dye, or any mixture thereof; carbonate salt such as sodium carbonate and/or sodium bicarbonate; carboxylate polymers such as co-polymers of maleic acid and acrylic acid.

Preferably, the composition comprises less than 1 wt % chlorine bleach and less than 1 wt % bromine bleach. Preferably, the composition is essentially free from bromine bleach and chlorine bleach. By "essentially free from" it is typically meant "comprises no deliberately added".

EXAMPLES

The following solid laundry detergent compositions are in accordance with the present invention:

| | A | B | C | D | E | F |
|---|---|---|---|---|---|---|
| Spray-dried particles | | | | | | |
| $C_{10-13}$ linear alkyl benzene sulfonate | 7.50 | 7.50 | 7.50 | 7.50 | 7.50 | 7.50 |
| $C_{12-16}$ alkyl ethoxylated sulphate having an average ethoxylation degree of 3 | | 1.00 | 1.00 | | | |
| Hydroxyethane di(methylene phosphonic acid) | 0.20 | 0.20 | 0.20 | 0.20 | 0.20 | 0.20 |
| Ethylenediamine disuccinic acid | 0.25 | 0.25 | 0.25 | 0.25 | 0.25 | 0.25 |
| Acrylate/maleate copolymer | 2.50 | 2.50 | 2.50 | 2.50 | 2.50 | 2.50 |
| Sodium carbonate | 22.50 | 22.50 | 22.50 | 22.50 | 22.50 | 22.50 |

-continued

| | A | B | C | D | E | F |
|---|---|---|---|---|---|---|
| Fluorescent-whitening agent | 0.15 | 0.15 | 0.15 | 0.15 | 0.15 | 0.15 |
| Magnesium sulphate | 0.45 | 0.45 | 0.45 | 0.45 | 0.45 | 0.45 |
| Sodium sulphate | 16.15 | 17.65 | 17.65 | 16.15 | 16.15 | 16.15 |
| Miscellaneous and water | 4.00 | 4.00 | 4.00 | 4.00 | 4.00 | 4.00 |
| Total spray-dried particles | 53.70 | 56.20 | 56.20 | 53.70 | 53.70 | 53.70 |
| Surfactant agglomerate | | | | | | |
| $C_{12-16}$ alkyl ethoxylated sulphate having an average ethoxylation degree of 3 | 6.00 | 6.00 | | 6.00 | 6.00 | 5.00 |
| $C_{10-13}$ linear alkyl benzene sulfonate | | | 5.00 | | | 1.00 |
| Sodium carbonate | 17.00 | 17.00 | 15.00 | 17.00 | 17.00 | 15.00 |
| Acrylate/maleate copolymer | | | 1.50 | | | 1.50 |
| Miscellaneous and water | 1.00 | 1.00 | 1.00 | 1.00 | 1.00 | 1.50 |
| Total surfactant agglomerate | 24.00 | 24.00 | 22.50 | 24.00 | 24.00 | 24.00 |
| Dry-added ingredients | | | | | | |
| Ingredient* | 1.00 | 1.00 | 1.00 | 1.00 | 1.00 | 1.00 |
| Sodium percarbonate having an AvOx of 14 wt % | 9.00 | 9.00 | 9.00 | | | 10.00 |
| Sodium carbonate | | | 2.50 | | | |
| Sodium sulphate | | | | 11.50 | 11.00 | |
| Acrylate/maleate copolymer | 1.50 | 1.50 | | 1.50 | 1.50 | |
| Enzymes | 0.50 | 0.50 | 0.50 | 0.50 | | 0.50 |
| Tetraacetylethylenediamine | 2.50 | 2.00 | 1.50 | | | 3.00 |
| Citric acid | 3.00 | 1.00 | 2.00 | 3.00 | 4.00 | 3.00 |
| Suds suppressor | 0.80 | 0.80 | 0.80 | 0.80 | 0.80 | 0.80 |
| Miscellaneous and water | to 100% | to 100% | to 100% | to 100% | to 100% | to 100% |

*The ingredient is selected from the group consisting of: a transition metal ion-based bleach catalyst, a bleach boosting ingredient, a highly ethoxylated non-ionic surfactant, a polyamidoamine, a quaternary nitrile bleach boosting ingredient, a hardness tolerant surfactant, burkeite, glucanase, lipase, polyvinyl pyrrolidone, carboxymethyl cellulose, fluorescent-whitening agents, and a non-ionic detersive surfactant.

The invention claimed is:

1. A solid laundry detergent composition in particulate form, comprising:

(a) anionic detersive surfactant;

(b) a calcium-augmented technology comprising a bleach boosting ingredient having a structure corresponding to Formula 2 below:

(2)

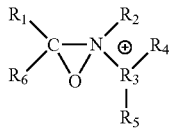

wherein: $R_1$ is a aryl or heteroaryl group; $R_2$ is an alkyl; $R_1$ and $R_2$ when taken together with the carbon and the nitrogen of the oxaziridinium form a ring; $R_3$ is a $C_1$ to $C_{20}$ substituted alkyl; $R_4$ is hydrogen, $R_2$ or, the moiety $Q_t$-A, wherein: Q is an alkylene, t=0 or 1 and A is an anionic group selected from the group consisting of $OSO_3^-$, $SO_3^-$, $CO_2^-$, $OCO_2^-$, $OPO_3^{2-}$, $OPO_3H^-$ and $OPO_2^-$; $R_5$ is hydrogen, $R_2$ or the moiety —$CR_{11}R_{12}$—X-$G_b$-$X_c$—[$(CR_9R_{10})_y$—O]$_k$—$R_8$, wherein: each X is independently selected from the group consisting of 0, S, N—H, or N—$R_8$; and each $R_8$ is independently selected from the group consisting of alkyl, aryl and heteroaryl, said $R_8$ moieties having less than 21 carbons; each G is independently selected from the group consisting of CO, $SO_2$, SO, PO and $PO_2$; $R_9$ and $R_{10}$ are independently selected from the group consisting of H and $C_1$-$C_4$ alkyl; and $R_{11}$ and $R_{12}$ are independently selected from the group consisting of H and alkyl, or when taken together may form a carbonyl; b=0 or 1; c can=0 or 1, but c must=0 if b=0; y is an integer from 1 to 6; k is an integer from 0 to 20; and $R_6$ is H, or an alkyl, aryl or heteroaryl moiety;

(c) from 0% to less than 5%, by weight of the composition, of zeolite builder;

(d) from 0% to less than 5%, by weight of the composition, of phosphate builder;

(e) optionally, from 0% to less than 5%, by weight of the composition, of silicate salt;

a polyaminoamide having a structure corresponding to the formula

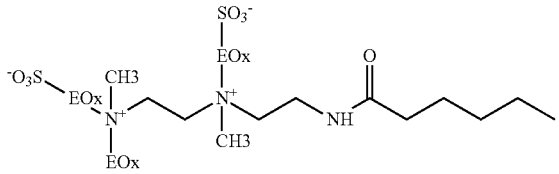

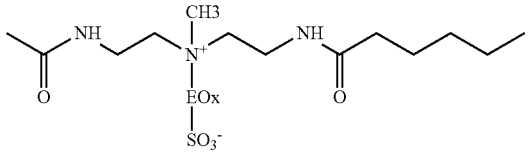

-continued

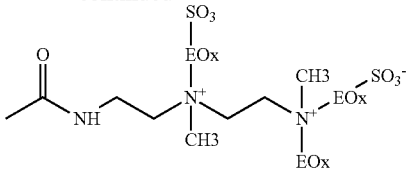

where EO represents an ethylene oxide unit and x is from 21 to 100;

(g) magnesium sulfate; and (h) an effervescence system.

2. A composition according to claim 1, wherein the composition comprises a transition metal ion-based bleach catalyst.

3. A composition according to claim 1, wherein composition comprises a highly ethoxylated non-ionic surfactant.

4. A composition according to claim 1, wherein the composition comprises a quaternary nitrile bleach boosting ingredient.

5. A composition according to claim 1, wherein the composition comprises a hardness tolerant surfactant system.

6. A composition according to claim 1, wherein the composition comprises burkeite.

7. A composition according to claim 1, wherein the composition comprises a glucanase.

8. A composition according to claim 1, wherein the composition comprises a lipase.

9. A composition according to claim 1, wherein the composition comprises a polyvinyl pyrrolidone.

10. A composition according to claim 1, wherein the composition comprises a carboxymethyl cellulose.

11. A composition according to claim 1, wherein the composition comprises a fluorescent-whitening agent.

12. A composition according to claim 1, wherein the composition comprises a non-ionic detersive surfactant.

13. A composition according to claim 12, wherein the non-ionic detersive surfactant is in solid form.

14. A composition according to claim 12, wherein the non-ionic detersive surfactant is a carbonate ester salt.

15. A composition according to claim 12, wherein the non-ionic detersive surfactant is an alkyl polyglucoside.

16. A composition according to claim 12, wherein the composition comprises silica and optionally a hydrotrope, and wherein the non-ionic detersive surfactant is in the form of a co-particulate with silica and optionally a hydrotrope.

* * * * *

UNITED STATES PATENT AND TRADEMARK OFFICE

CERTIFICATE OF CORRECTION

PATENT NO. : 7,910,533 B2
APPLICATION NO. : 11/504918
DATED : March 22, 2011
INVENTOR(S) : Nigel Patrick Somerville Roberts et al.

It is certified that error appears in the above-identified patent and that said Letters Patent is hereby corrected as shown below:

Column 6
Line 34, delete "$OP_3^{2-}$" and insert -- $OPO_3^{2-}$ --.

Column 11
Line 29, delete "10k0" and insert --100 --.

Column 14
Line 6, delete "lanuginosa" and insert -- Ianuginosa --.

Column 19
Line 59, delete "0" and insert -- O --.

Column 20
Line 45, delete "a polyaminoarnide" and insert -- (f) a polyaminoamide --.

Signed and Sealed this
Seventh Day of February, 2012

David J. Kappos

David J. Kappos
*Director of the United States Patent and Trademark Office*